United States Patent [19]

Roou

[11] Patent Number: 4,841,712

[45] Date of Patent: Jun. 27, 1989

[54] METHOD OF PRODUCING SEALED PROTECTIVE POUCHS WITH PREMIUM OBJECT ENCLOSED THEREIN

[75] Inventor: Richard J. Roou, Gladstone, Mo.

[73] Assignee: Package Service Company, Inc., Kansas City, Mo.

[21] Appl. No.: 134,369

[22] Filed: Dec. 17, 1987

[51] Int. Cl.[4] ..... B65B 61/18; B65B 63/04

[52] U.S. Cl. ..... 53/412; 53/430; 53/435; 53/450; 156/248; 156/267; 156/268; 156/277; 156/301; 156/344

[58] Field of Search ..... 53/411, 412, 430, 435, 53/450, 513, 520; 156/248, 267, 268, 277, 301, 344; 493/401

[56] References Cited

U.S. PATENT DOCUMENTS

| | | | |
|---|---|---|---|
| 2,563,071 | 8/1951 | Salfisberg | 53/520 |
| 2,680,943 | 6/1954 | Petersen | 53/520 |
| 2,789,640 | 4/1957 | Belden | 53/520 |
| 3,140,572 | 7/1964 | Petersen et al. | 53/435 |
| 3,394,798 | 7/1968 | Sako | 53/450 |
| 3,497,948 | 3/1970 | Wiesler et al. | 53/435 |
| 3,834,113 | 9/1974 | Howe et al. | 53/412 |
| 4,074,505 | 2/1978 | Keren et al. | 53/450 |
| 4,153,496 | 5/1979 | Swift | 156/248 |
| 4,219,596 | 8/1980 | Takemoto et al. | |
| 4,359,358 | 11/1982 | Hattemer | |
| 4,365,716 | 12/1982 | Watt | |

*Primary Examiner*—Robert L. Spruill
*Assistant Examiner*—Beth Bianca
*Attorney, Agent, or Firm*—Hovey, Williams, Timmons & Collins

[57] ABSTRACT

A premium item including a sealed protective pouch having a premium object such as a coupon or sports card enclosed therein and method are provided which allow economical, continuous, on-line production of premium items without the need for individual handling of the premium objects. In the preferred method, a printed web having a backing sheet removably adhered thereto is continuously positioned on a carrier sheet having an adhesive coating, with the backing sheet in contact with the coating, whereupon the web and backing sheet are die-cut to produce a plurality of spaced-apart premium objects on the carrier sheet and a waste matrix which is then removed. A top sheet is then positioned over the premium objects with marginal portions of the top sheet adhering to corresponding marginal portions of the carrier sheet to form a continuous seal surrounding the premium objects and to form sealed protective pouches enclosing the premium objects.

15 Claims, 1 Drawing Sheet

METHOD OF PRODUCING SEALED PROTECTIVE POUCHS WITH PREMIUM OBJECT ENCLOSED THEREIN

BACKGROUND OF THE INVENTION

1. Field of the Invention

The present invention relates to a premium object including a sealed protective pouch having a premium object such as a coupon enclosed therein, and a method which allows economical, continuous, on-line production of such premium items without the need for individual handling of the premium objects. More particularly, the invention hereof relates to a carrier sheet having adhesive coating thereon, a premium object having a backing sheet in contact with the coating, and a top sheet overlaying the premium object and marginally adhering to the carrier sheet in order to form the pouch and in order to form a continuous seal surrounding the premium object.

2. Description of the Prior Art

Producers of packaged food products such as potato chips or the like often include premium objects such as coupons, baseball cards, and so forth in the food package as part of a merchandising program. The premium objects, however, must be enclosed in a sealed, protective pouch in order to protect the objects from oil, moisture, colorings, and so forth present in the food products, and to ensure that the premium object itself does not contact the food product.

Heretofor, premium objects have been enclosed in a protective pouch by first producing the objects and then individually placing them on a production line in which a cellophane wrapper, or the like, is placed around each premium object and heat sealed in order to form a protective pouch around the premium object.

Known prior art methods of producing premium objects enclosed by protective pouches are inefficient in that the premium objects must be first separately manufactured and then individually placed for enclosure by the pouch material.

SUMMARY OF THE INVENTION

The problems as outlined above are solved by the premium item and method of the present invention. That is to say, the invention hereof allows economical, continuous, on-line production of sealed protective pouches enclosing respective premium objects without the need for individual handling of the premium objects.

The premium item hereof comprises a premium object enclosed in a sealed protective pouch. The pouch includes a top sheet presenting a top wall portion positioned adjacent the top face of the premium object, and a top sealing zone surrounding the top wall portion and continuously extending marginally outwardly beyond the top face. The pouch also includes a bottom sheet (or carrier sheet) presenting a bottom wall portion positioned adjacent the bottom face of the premium object, and a bottom sealing zone continuously surrounding the bottom wall portion and continuously extending outwardly beyond the bottom face. Finally, the pouch includes means for sealing the top and bottom sealing zones in order to form a continuous seal marginally surrounding the premium object whereby the top and bottom sheets form a protective pouch enclosing the premium object.

Preferably, the premium object includes a backing sheet removably adhered thereto, and the bottom sheet includes an adhesive coating thereon. The backing sheet is in contact with the adhesive coating, and the top sealing zone sealed to the corresponding bottom sealing zone by means of the adhesive coating.

The preferred method comprises the steps of providing a carrier sheet, placing a premium web in aligned, superposed relationship with the carrier sheet, cutting the web in order to produce a plurality of spaced-apart premium objects and a waste matrix; removing the waste matrix; positioning a top sheet in aligned superposed relationship with the carrier sheet with the premium objects therebetween; and sealing the respective top sealing zones to corresponding carrier sealing zones in order to perform a plurality of continuous sealed zones respectively surrounding the premium objects. The sealed zone and the carrier and top sheets define a plurality of sealed protective pouches with the respective premium objects enclosed therein.

Preferably, the premium web includes a backing sheet releasably adhered thereto and the carrier sheet includes an adhesive coating on the top surface thereof. The web is placed on the carrier sheet with the web backing sheet in contact with the adhesive coating. The top sealing zones are sealed to the corresponding carrier sealing zones by means of the adhesive coating on the carrier sheet.

BRIEF DESCRIPTION OF THE DRAWING FIGURES

DETAILED DESCRIPTION OF THE PREFERRED EMBODIMENTS

Figure 1:
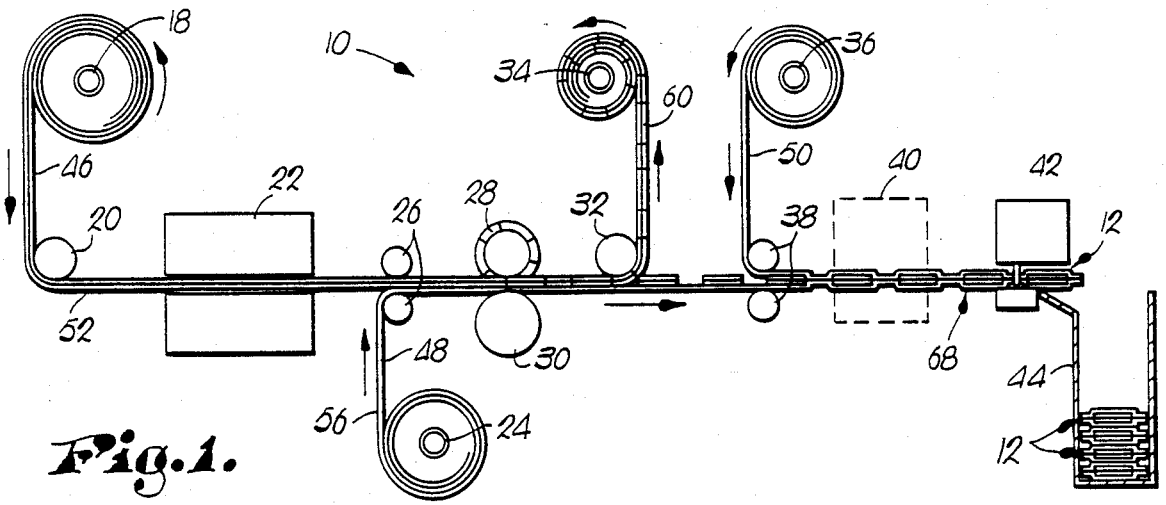
FIG. 1 is a schematic representation of a label manufacturing machine used for producing the premium items and for implementing the method of the present invention.

FIG. 1 schematically illustrates a conventional pressure sensitive label manufacturing machine 10 such as the Webtron 650 manufactured by Webtron, Inc. of Fort Lauderdale, Florida. Machine 10 is the apparatus of choice for implementing the method of the present invention although those skilled in the art will appreciate that other functionally equivalent machines can be used equivalently. Machine 10 is preferably used to produce premium item 12 of the present invention which includes sealed protective pouch 14 and a premium object 16.

Label manufacturing machine 10 includes web dispensing reel 18, web guide roller 20, conventional flexographic printer 22, carrier sheet dispensing reel 24, a pair of carrier-web engagement rollers 26, die cutter 28, anvil roller 30, matrix stripping roller 32, matrix takeup reel 34, top sheet dispensing reel 36, a pair of top-carrier laminating rollers 38, optional heat sealer 40, cutter 42, and premium item collection rack 44.

Machine 10 is supplied with web 46, bottom or carrier sheet 48, and top sheet 50, all in roll form.

Web 46 is preferably composed of eightpoint tag material and surface coated on the upper surface thereof to facilitate printing. Additionally, web 46 includes a release liner or backing sheet 52 composed of 40 pound kraft material removably adhered to the lower surface of web 46 by means of an adhesive layer 54 composed of conventional pressure sensitive adhesive.

Web dispensing reel 18 continuously dispenses the self-wound roll of web 46 including backing sheet 52 around web guide roller 20, through printer 22, and between carrier-web engagement rollers 26.

Printer 22 is conventionally used, for example, to print web 46 and backing sheet 52, with desired indicia and images in order to form a merchandising coupon or sports trading card having the image of a notable sports figure thereon.

Carrier sheet 48 is preferably received in the form of a self-wound roll of 1 mil, biaxially oriented polypropylene. Sheet 48 presents top surface 56 which includes adhesive coating 58 thereon preferably composed of acrylic emulsion adhesive known as Type 15T10, available from Devon Corporation which is oil, water, and grease resistant.

Carrier sheet dispensing reel 24 continuously dispenses sheet 48 between carrier-web engagement rollers 26 so that adhesive coating 58 comes into contact with the lower surface of web backing sheet 52. Engagement rollers 26 place web 46 and carrier sheet 48 in contact with one another so that top surface 56 is adhered to the lower surface of backing sheet 52 by means of adhesive coating 58.

Web 46 and carrier sheet 48 then continuously pass between die cutter 28 and anvil roller 30 so that die cutter 28 cuts through web 46 and backing sheet 52 in order to produce spaced-apart, premium objects 16 surrounded by waste matrix 60.

Matrix take-up reel 34 continuously removes waste matrix 60 by way of matrix stripping roller 32 which is in contact with the top surface of die cut web 46.

After removal of waste matrix 60, spaced-apart premium objects 16 remain in contact with and adhered to carrier sheet 48. The removal of waste matrix 60 exposes portions of top surface 56 and adhesive coating 58 which portions marginally and continuously surround each premium object 16. These exposed portions present a plurality of carrier sealing zones 62 respectively surrounding each premium object 16.

Carrier sheet 48 with premium objects 16 thereon then passes between top-carrier laminating rollers 38.

Top sheet 50 is preferably received as a self-wound roll of 75 gauge (3/4 mil) corona-treated, biaxially oriented polypropylene.

Top sheet dispensing reel 36 continuously dispenses top sheet 50 between top-carrier laminating rollers 38 which place top sheet 50 in contact with the upper surface of premium object 16 and with sealing zones 62. Preferably, top sheet 50 is the same width as carrier sheet 48 and thereby presents a corresponding plurality of top sheet sealing zones 64 corresponding to carrier sealing zones 62.

Rollers 38 place top sheet sealing zones 64 into contact with carrier sealing zones 62 which adhere together because of adhesive layer 54. Sealing zones 62 and 64 thereby form a plurality of corresponding sealed zones 66 continuously and marginally surrounding each premium object 16 as best viewed in FIG. 2. Carrier sheet 48 and top sheet 50 joined at sealed zones 66, thereby form an assembly 68 of premium items 12 each including a sealed protective pouch 14 and a premium object 16 enclosed therein.

Cutter 42 then separates premium items 12 from assembly 68 by laterally cutting through carrier sheet 48 and top sheet 50 about midway between each premium object 16. The separated premium items then fall into collection rack 48 or in the alternative, onto a conveyor system. Cutter 42 also cuts longitudinal, centrally disposed tear slits 70 at the juncture between adjacent premium items 12. Tear slits 70 extend partially into the sealed zones at opposed ends of each premium item 12.

Cutter 42 can also be used instead to cut lateral perforations or knife slits to act as feed slots between each premium item rather than completely separating them from assembly 68. In this way, assembly 68 can be formed into a self-wound roll if desired.

Figure 2:
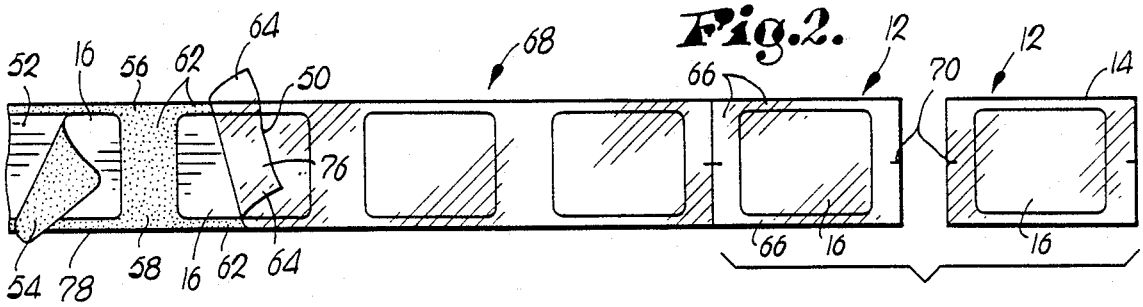
FIG. 2 is a plan view of an assembly of premium items produced by the machine of FIG. 1.
Figure 6:
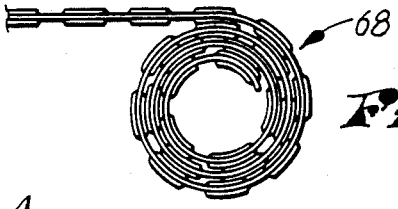
FIG. 6 is a view showing an alternative embodiment of forming an assembly into a roll.

As illustrated in FIG. 2, asembly 68 moves to the right for premium item separation by cutter 42. Those skilled in the art will appreciate that assembly 68 can be arranged so that two or more premium items 12 are produced side-by-side whereby cutter 42 is configured appropriately to separate items 12 and cut slits 70.

Additionally, carrier sealing zones 62 and top sheet sealing zones 64 could be heat sealed together by means of heat sealer 40. If such is desired, a low tack adhesive would be needed to adhere web 46 to carrier sheet 48 during the operation of die cutter 28 and subsequent removal of waste matrix 60 and to hold premium objects 16 in place on carrier sheet 48 until the heat sealing operation is complete.

Figure 3:
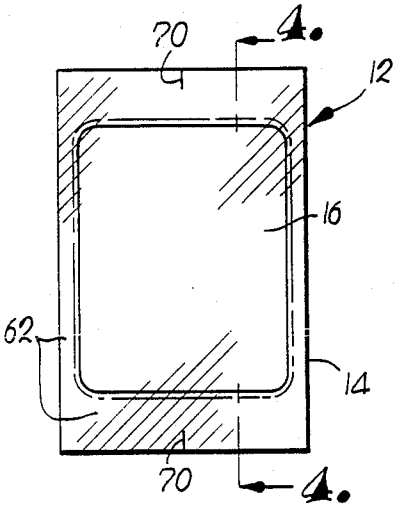
FIG. 3 is a plan view of a sealed protective pouch with a premium object enclosed therein.
Figure 5:
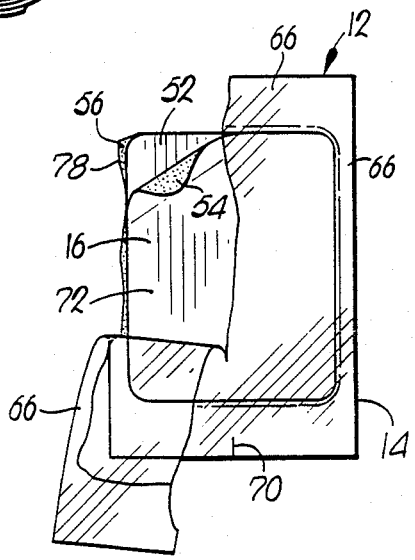
FIG. 5 is a view similar to FIG. 4 showing the top sheet partially torn away and the premium object partially removed from the backing sheet.
Figure 4:
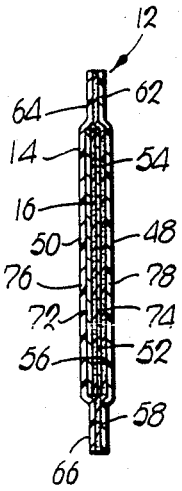
FIG. 4 is a sectional view of the premium item of FIG. 3 taken along line 4—4.

FIGS. 3, 4, and 5 illustrate in more detail the construction of premium item 12 preferably produced by the method of the present invention. Premium object 16 presents top face 72 and bottom face 74. Top sheet 50 presents a top wall portion 76 in juxtaposed relationship with top face 72. Top sealing zone 64 marginally surrounds top wall portion 76 and continuously extends marginally outwardly beyond top face 72.

Bottom (or carrier) sheet 48, presents bottom wall portion 78 in juxtaposed relationship with bottom face 74 with bottom (or carrier) sealing zone 62 marginally surrounding bottom wall portion 78. Sealing zone 62 also continuously extends marginally outwardly beyond bottom face 74.

Adhesive coating 58 is the preferred means for sealing top sealing zone 64 and bottom sealing zone 62 together to form continuous sealed zone 66 marginally surrounding premium object 16. With this construction, bottom sheet 48 and top sheet 50 cooperate to form pouch 14 enclosing premium object 16.

Preferably, premium object 16 includes a backing sheet 52 the bottom surface of which is adhered to top surface 56 of bottom wall portion 78 by means of adhesive coating 58. As discussed above, adhesive layer 54 adheres backing sheet 52 to premium object 16.

To remove premium object 16 from pouch 14, the user grasps item 12 on either side of tear slit 70 and then tears briskly downwardly. This causes bottom sheet 48 and top sheet 50 to continuously tear more or less centrally therethrough. Premium object 16 can then be grasped and peeled away from backing sheet 52.

Those skilled in the art will appreciate that adhesive layer 54 adhering premium object 16 to backing sheet 52 can be composed of a pressure sensitive adhesive whereby premium object 16, once removed, can then be adhered to another surface. Alternately, adhesive layer 54 could be composed of a very low tack or releasable adhesive, if desired.

Having thus described the preferred embodiment of the present invention, the following is claimed as new and desired to be secured by Letters Patent:

I claim:

1. A method for producing a plurality of sealed protective pouches having a respective plurality of premium objects enclosed therein, said method comprising the steps of:

providing a carrier sheet including a contact surface having an adhesive coating thereon;

placing a web in aligned superimposed relationship with said carrier sheet;

releasably adhering said web to said carrier sheet;

cutting said web while adhered to said carrier sheet in order to produce a plurality of spaced-apart premium objects and a waste matrix;

removing said waste matrix, said carrier sheet presenting a plurality of carrier sealing zones in respective, continuously surrounding, marginal relationship with said premium objects and presenting a corresponding plurality of carrier walls;

positioning a top sheet aligned superposed relationship with said carrier sheet with said premium objects therebetween;

said top sheet presenting a plurality of top sealing zones corresponding to said carrier sealing zones in respective, continuously surrounding, marginal relationship with said premium objects and presenting a corresponding plurality of top walls; and sealing said top sealing zones to said corresponding carrier sealing zones in order to form a plurality of continuous sealed zones respectively surrounding said premium objects, said sealed zones and respective corresponding carrier and top walls defining said sealed protective pouches with said respective plurality of premium objects enclosed therein.

2. The method as set forth in claim 1, further including the step of separating said pouches with said premium objects enclosed therein from one another.

3. The method as set forth in claim 2, further including the step of defining a tear slit in each of said sealed zones for aiding in tearing each of said pouches in order to expose said respective premium objects for removal therefrom.

4. The method as set forth in claim 1, said pouches and enclosed premium objects making up an assembly, said method further including the step of forming said assembly into a roll.

5. The method as set forth in claim 1, said sealing step including the step of placing said top sealing zones in contact with said corresponding carrier sealing zones whereby said adhesive coating causes said zones to adhere to one another in order to form said sealed zones.

6. The method as set forth in claim 1, said carrier sheet, said top sheet, and said web being elongated and each presenting the same width.

7. The method as set forth in claim 1, said sealing step including the step of placing said sealing zones in contact with one another and heat sealing said zones in order to form said sealed zones.

8. The method as set forth in claim 1, further including the step of providing said web removably adhered to a backing sheet, said releasably adhering step including the step of releasably adhering said web to said carrier sheet with said backing sheet therebetween, said cutting step including the step of cutting said web and backing sheet in order to produce said plurality of spaced-apart premium objects and respective, corresponding, backing sheet portions.

9. A method of continuous, on-line production of a plurality of sealed protective pouches respectively enclosing a corresponding plurality of premium objects, said method comprising the steps of:

continuously providing an elongated carrier sheet including a contact surface having an adhesive coating thereon;

continuously placing an elonaged web in aligned superposed relationship with said carrier sheet;

continuously releasably adhering said web to said carrier sheet;

continuously cutting said web while adhered to said carrier sheet in order to produce a plurality of spaced-apart premium objects and a waste matrix therefrom;

continously removing said waste matrix, said carrier sheet presenting a plurality of carrier sealing zones marginally and respectively disposed about said premium objects and presenting a corresponding plurality of carrier wall portions marginally defined by said respective carrier sealing zones;

continuously positioning an elongated top sheet in aligned superposed relationship with said carrier sheet with said premium objects therebetween, said to sheet presenting a plurality of top sealing zones respectively corresponding to carrier sealing zones and presenting a corresponding plurality of top wall portions marginally defined by said respective top sealing zones; and continuously sealing said top zones to said corresponding carrier zones in order to form a corresponding plurality of sealing zones marginally and respectively surrounding said premium objects, said sealing zones and said to wall and carrier wall portions respectively making up said protective pouches respectively enclosing said premium objects.

10. The method as set forth in claim 9, said sealing step further including the step of placing said top sealing zones in corresponding contact with said carrier sealing zones whereby said coating seals said top sealing zones to said corresponding carrier sealing zones.

11. The method as set forth in claim 9, said carrier sheeting presenting a top surface having an adhesive coating thereon;

said top surface including said carrier sealing zones, said sealing step including the step of placing said top sealing zones in corresponding contact with said carrier sealing zones whereby said coating seals said top zones to said corresponding carrier zones.

12. The method as set forth in claim 11, said web including a backing sheet releasably adhered thereto, said placing step including the step of placing said backing sheet in contact with said top surface.

13. The method as set forth in claim 9, further including the step of defining at least one tear slit in ones of said sealing zones corresponding to each of said pouches.

14. The method as set forth in claim 9, further including the step of separating said pouches with said premium objects enclosed therein from one another.

15. The method as set forth in claim 9, further including the step of continuously providing said web removably adhered to a backing sheet, said continuously releasably adhering step including the step of continuously releasably adhering said web to said carrier sheet with said backing sheet therebetween, said continuously cutting step including the step of continously cutting said web and backing sheet in order to produce said plurality of spaced-apart premium objects and respective, corresponding, backing sheet portions.

* * * * *

UNITED STATES PATENT AND TRADEMARK OFFICE

CERTIFICATE OF CORRECTION

PATENT NO. : 4,841,712

DATED : June 27, 1989

INVENTOR(S) : RICHARD J. ROOU

It is certified that error appears in the above—identified patent and that said Letters Patent is hereby corrected as shown below:

Col. 5, line 13, change "superimposed" to --superposed--.
Col. 5, line 25, after "sheet" add --in--.
Col. 5, line 36, change "sealed" to --sealing--.
Col. 6, line 15, change "elonaged" to --elongated--.
Col. 6, line 33, change "to" to --top--.
Col. 6, line 34, after "to" add --said--.
Col. 6, line 42, change "to" to --top--.

Signed and Sealed this

Twenty-fourth Day of July, 1990

*Attest:*

HARRY F. MANBECK, JR.

*Attesting Officer*

*Commissioner of Patents and Trademarks*